United States Patent [19]

Vinson

[11] 4,296,498

[45] Oct. 27, 1981

[54] REVERSIBLE GARMENT

[76] Inventor: Joseph J. Vinson, 2009 Blossom La., Marshalltown, Iowa 50159

[21] Appl. No.: 155,417

[22] Filed: Jun. 2, 1980

[51] Int. Cl.[3] ..... A41B 1/00

[52] U.S. Cl. ..... 2/115

[58] Field of Search ..... 2/115, 108

[56] References Cited

U.S. PATENT DOCUMENTS 1,113,977 10/1914 Freedman ..... 2/108

4,078,265 3/1978 Condit ..... 2/115

*Primary Examiner*—Doris L. Troutman

*Attorney, Agent, or Firm*—James C. Nemmers; Haven E. Simmons

[57] ABSTRACT

A one piece athletic jersey on which the identification number or color can be quickly changed without removing the jersey. The jersey has a full flap of material hinged along the top of the shoulder seam which flap can be switched from the front or back by raising the flap over the head of the wearer. If the jersey is two-colored, the opposite sides of the flap are different colors corresponding to those of the jersey so that depending upon the position of the flap, the jersey will be one or the other of the two colors.

3 Claims, 4 Drawing Figures

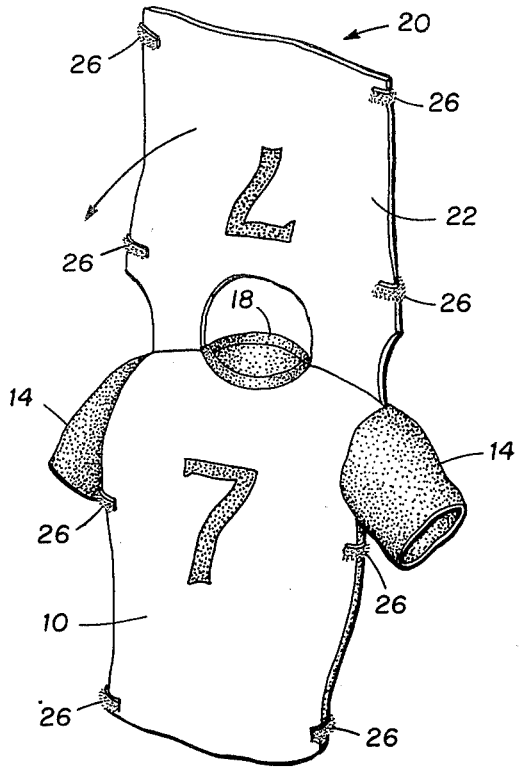
FIG 1
FIG 2
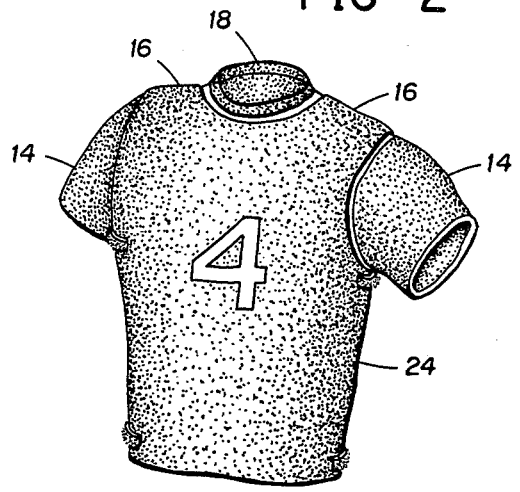
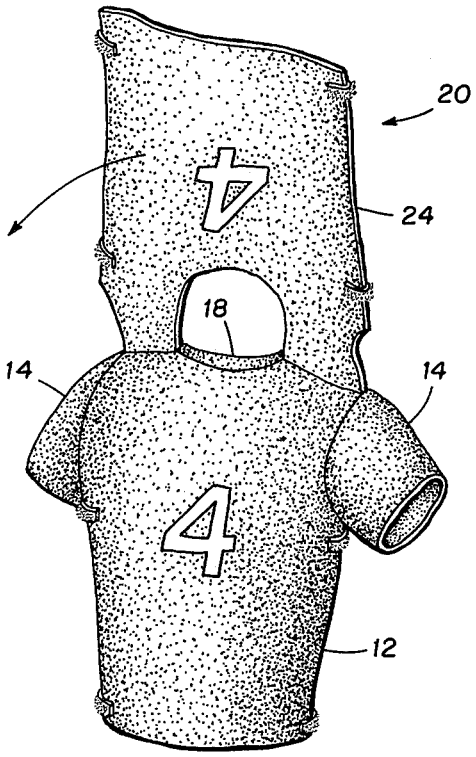
FIG 3
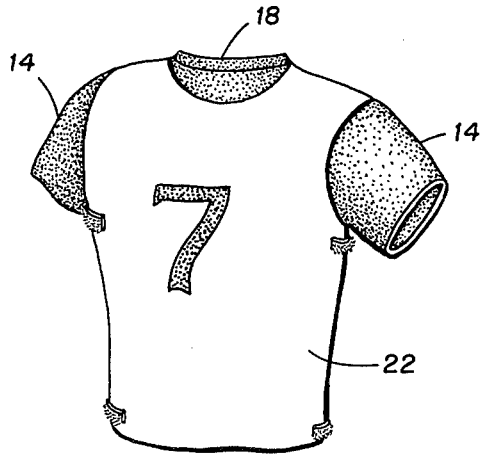
FIG 4

REVERSIBLE GARMENT

BACKGROUND OF THE INVENTION

Participation by girls and women in athletic competition has increased tremendously in recent years primarily because of federal legislation that requires equal opportunities for women in athletic competition in educational institutions at all levels. Thus, women and girls are now participating in record numbers in all sports including such team sports as basketball and volleyball. In team sports, competition is encouraged and evaluation of the players is accomplished by allowing all to participate during the practice sessions. Because individual team members are changed numerous times during a practice session, and individuals are commonly switched from one team to another, this requires individuals to change team identification. This is generally accomplished by having uniforms, or at least jerseys, of two different colors. The individual then exchanges jerseys with another individual when he or she moves from one team to another. There are also available reversible jerseys of different inside and outside colors which can be removed, turned inside out and then put back on by an individual who switches from one team to another.

Because practice sessions are not always conducted in private, and in many instances women's or girls' teams are coached by male staff members, modesty requires that when a female player has to change her jersey she must go to the locker room and return. This can occur several times during a practice session. This disrupts the practice session and also can waste a considerable amount of time when there is usually a very limited amount of time available for a practice session.

One solution that has been proposed is for all participants to wear a basic jersey of the same color and then have a second jersey of a different color that can be worn over the basic jersey. This of course requires a second set of jerseys, and requires twice as many garments to be accounted for and possibly lost.

In addition, even when only male participants are involved, some object to exchanging soiled jerseys or being required to wear a jersey that may or may not fit properly.

Also, in football, it is common for a single player to play different positions on different specialty teams. This requires that player to change numbers that are proper for the position he is playing. This is usually done by a detached slipover jersey, and the player must usually go to the sidelines to obtain the slipover. This takes time and sometimes there is not sufficient time to make the change. Also, the detached jersey can become easily misplaced.

There is therefore a definite need for a single garment that can be quickly changed to change the identification of color, number, etc. without removing the garment. It is also preferable that such a garment be of one piece so that the player has only a single garment for which he or she is accountable.

SUMMARY OF THE INVENTION

The invention provides a one piece jersey that can be "reversed" without removing the garment. The jersey is a standard short sleeve or sleeveless garment, the front of which is one color and the back a different color. A single panel which is one color on one side and the other color on the opposite side is permanently attached to the jersey along the shoulder seams. Suitable fasteners, such as Velcro fasteners, are provided along the sides of the garment to keep the flap secured to the garment whether the flap covers the back or the front. Thus, by loosening these fasteners, the flap can be quickly and easily swung over the head of the wearer in order to "change" the color of the basic jersey from one color to the other. Of course, the same technique can be employed using a different pair of numbers or other different means of identification.

BRIEF DESCRIPTION OF THE DRAWINGS

FIG. 1 is a perspective view of a jersey constructed according to the invention showing the front of the jersey and showing the flap being swung from the back to the front of the jersey;

FIG. 2 is a perspective view similar to FIG. 1 and showing the flap secured in place over the front of the jersey;

FIG. 3 is a perspective view of the rear of the jersey and showing the flap being swung from the front to the back; and FIG. 4 is a perspective view of the back of the jersey showing the flap secured in place over the back of the jersey.

DESCRIPTION OF THE PREFERRED EMBODIMENT OF THE INVENTION

In all of the figures of the drawing, a portion of the jersey has been shaded to indicate that the shaded portion is of a different color then the unshaded portion. Of course, the garment need not be of two solid colors but can be of any pattern or combination of pattern and color that would readily distinguish the garment when it is reversed. There has also been indicated on the drawing two different numerals. It should be understood that the garment could be of a single color with the only differing indication being the difference in numbers.

Referring now to the drawing, particularly FIGS. 1 and 3, there is shown an upper garment, such as an athletic jersey, which garment has a front panel 10, a back panel 12 and sleeves 14. The front and back panels 10 and 12 are joined along the top of the shoulder as at 16, and are provided with a neck opening 18. As is customary, the front of the neck opening is lower than the back. The front panel 10 and back panel 12 are joined permanently along the sides in any conventional manner.

As best seen in FIGS. 1 and 3, the front panel 10 is of a different color then the back panel 12, and if desired, the front panel 10 can be imprinted in any suitable manner with a different numeral or other designation different from that on the back panel 12. In the drawing, FIG. 1 shows the numeral "7" imprinted on front panel 10 and the numeral "4" imprinted on the back panel 12. The sleeves 14 can be of either color, and as illustrated in the drawing, sleeves 14 are the same color as the back panel 12.

The description of the jersey so far is nothing more than a standard jersey or t-shirt that has a different colored front and back with different numerals on the front and back. Of course, unless made for a special purpose, such jerseys would generally be all of one color or all of one design and generally would have the same identifying numeral on the front and back.

The jersey of the invention, however, has an additional piece of material in the form of a reversible flap indicated generally by the reference numeral 20. As best seen in FIG. 2, flap 20 is sewn or otherwise permanently attached to the jersey along the tops of the shoulders 16. Preferably, the flap 20 is attached along both shoulder seams, but could be attached along only one of the shoulders if desired. The flap 20 should be permanently affixed so that it cannot become detached from the jersey. Flap 20, therefore, forms an integral part of the jersey.

The flap 20 has a first side 22 and a second side 24, side 22 being of a different color then side 24. As illustrated in the drawing, side 22 is the same color as front panel 10 and contains the same identifying numeral "7", and side 24 is the same color as the back panel 12 and contains the same identifying numeral "4". Sewn across the side seams of the flap 20 and across the side seams of the jersey where the front panel 10 joins the back panel 12 are suitable fasteners 26 such as "Velcro" type fasteners. Fasteners 26 permit the flap 20 to be secured in position when it covers the front panel 10 (see FIG. 2) or when it covers the back panel 12 (see FIG. 4).

The use of the jersey of my invention should be evident from the foregoing description. However, following is a brief summary of its use. FIG. 2 shows the jersey with the flap 20 secured in position covering the front panel 10. In this position, the jersey will be all one color and the numerals "4" will be displayed on both the front and back of the jersey. If it is desired to "reverse" or change the identification provided by the jersey, flap 20 is unfastened and swung over the head of the wearer from front to back as illustrated in FIG. 3. The flap 20 is then secured in place as shown in FIG. 4, which shows the numeral "7" on the back of the jersey. The numeral "7" will also appear on the front of the jersey as seen in FIG. 1. In this position with the flap 20 covering the back panel, the jersey will display a second color. When it is desired to again reverse or change the jersey, the flap 20 is unfastened and swung from the back to the front as illustrated in FIG. 1.

It will be evident from the foregoing description that my invention provides a "reversible" jersey in which the indicating means can be quickly and easily changed whether that indicating means be a color, a design, numeral, etc. Since the jersey is one piece, there is nothing to become detached and lost. Also, a player can be issued a single jersey that will fit thus avoiding the exchange of jerseys of different sizes. The indicating means, such as the color, can be quickly and easily changed without the necessity of removing the jersey thereby preserving the modesty of the player and permitting the jersey to be "changed" in public. Since the user does not have to exchange jerseys with another person, the unsanitary aspect of exchanging with someone else's "soiled" jersey is eliminated.

Obviously, a jersey can be made using the principles of the invention whether the jersey be made with sleeves, sleeveless, v-neck, scoop neck, etc. Since a proper size jersey can be issued to a player, my invention provides a safety feature in that the jersey will fit and will not interfere with the player's activity. Nor will the jersey of the invention be apt to slip off as would be the case where a conventional jersey would be exchanged with one of a larger size. Moreover, the jersey of the invention eliminates the problems that occur with the use of "pinnies" which often slip off because they are supplied in one large size only.

Having thus described the preferred embodiment of my invention, it will be obvious to those skilled in the art that various other revisions and modifications and applications can be made without departing from the spirit and scope of the invention. It is my intention, however, that all such revisions and modifications as are obvious to those skilled in the art will be included within the scope of the following claims.

I claim:

1. A reversible garment such as a jersey or the like for the upper part of the body, comprising:

(a) a front and back panel joined together at seams having sleeves and a neck opening that form a pullover upper-body garment, (b) said front panel having an identifying characteristic different from the back panel, (c) said front and back panels being of substantially the same size and shape, (d) a reversible flap having cutouts for said sleeves and conforming in size and shape to said front and said back panel and having side and bottom edges.

(e) said flap being permanently affixed to said garment so as to be selectively movable from a position over either the entire front panel or the entire back panel to cover the identifying characteristics of one of said panels when moved into a panel covering position, (f) said flap having different identifying characteristics on its opposite sides which characteristics correspond to those contained on the front and back panels so that the same identifying characteristics will be displayed on the front and the back of the garment simultaneously regardless of the selected position of the flap, and (g) a first and a second fastening means for securing the side edges of the flap in one of said selected positions over at least one of said panels.

2. The reversible garment as in claim 1, wherein:

(a) the first fastening means for securing said side edges of said flap to said front or back panel are located directly underneath the cutouts for said sleeves, and (b) the second fastening means for securing said side edges of said flap to said front or back panel are located further down from said first fastening means and said cutouts close to said bottom edge of said front or back panel.

3. The reversible garment as in claim 2, wherein:

(a) the first and second fastening means are velcro fasteners and (b) said velcro fasteners are sewn across the side edges of said flap and across said seams joining said front and back panels.

* * * * *